US010292501B1

(12) United States Patent
Brown

(10) Patent No.: US 10,292,501 B1
(45) Date of Patent: May 21, 2019

(54) CHAIR WITH ADJUSTABLE FOOT REST

(71) Applicant: Rupert Brown, Clewiston, FL (US)

(72) Inventor: Rupert Brown, Clewiston, FL (US)

( * ) Notice: Subject to any disclaimer, the term of this patent is extended or adjusted under 35 U.S.C. 154(b) by 0 days.

(21) Appl. No.: 15/954,738

(22) Filed: Apr. 17, 2018

(51) Int. Cl.

| | |
|---|---|
| ***A47C 1/04*** | (2006.01) |
| ***A47C 1/06*** | (2006.01) |
| ***A47C 7/50*** | (2006.01) |
| ***A47C 7/00*** | (2006.01) |
| ***A47C 7/40*** | (2006.01) |

(52) U.S. Cl.
CPC ..... *A47C 7/506* (2013.01); *A47C 1/04* (2013.01); *A47C 1/06* (2013.01); *A47C 7/004* (2013.01); *A47C 7/40* (2013.01)

(58) Field of Classification Search
CPC ..... A47C 1/04; A47C 1/06; A47C 7/506
See application file for complete search history.

(56) References Cited

U.S. PATENT DOCUMENTS

| | | | | | |
|---|---|---|---|---|---|
| 156,004 | A | | 10/1874 | Wayland | |
| 1,168,071 | A | * | 1/1916 | Holzbaur | A47C 1/06 297/344.21 |
| 1,505,829 | A | | 8/1924 | Warnecke | |
| 1,738,284 | A | * | 12/1929 | Carter | A47C 1/06 297/358 |
| 1,948,786 | A | | 2/1934 | Dorrell | |
| 2,091,733 | A | * | 8/1937 | Hemminger | A47C 1/06 297/353 |
| 2,529,532 | A | * | 11/1950 | Abbott | A47C 1/11 297/256 |
| 2,884,047 | A | * | 4/1959 | Abbott | A47C 1/06 297/339 |
| 3,278,224 | A | * | 10/1966 | Dlouhy | A47C 1/06 297/71 |
| 3,305,822 | A | * | 2/1967 | Dlouhy | A47C 1/06 248/404 |
| 4,358,156 | A | | 11/1982 | Sharff | |
| 4,372,605 | A | * | 2/1983 | Cervantes | A47C 1/04 297/188.11 |
| 5,039,167 | A | | 8/1991 | Sweet | |
| 6,145,931 | A | | 11/2000 | Subotic | |
| 6,296,310 | B1 | * | 10/2001 | Laudenslayer | A47C 1/06 297/344.19 |
| 7,975,886 | B2 | | 7/2011 | McAllister | |
| D650,603 | S | | 12/2011 | Petruccelli | |
| 8,534,762 | B2 | | 9/2013 | Linhoff | |
| 2005/0225151 | A1 | | 10/2005 | Zenisek | |
| 2014/0239676 | A1 | * | 8/2014 | Yagi | A47C 1/035 297/75 |
| 2016/0128482 | A1 | * | 5/2016 | Wallace | A47C 1/06 297/183.1 |

* cited by examiner

*Primary Examiner* — Timothy J Brindley

(57) ABSTRACT

The chair with adjustable foot rest is a chair. The chair with adjustable foot rest is configured for use in helping an individual don footwear and socks. The chair with adjustable foot rest comprises a bollard, a chair structure, and a foot rest structure. The bollard and the foot rest structure attach to the chair structure. The foot rest structure moves towards and away from the chair such that the foot rest structure will support a foot at a convenient position. The position of the foot rest structure is controlled using a hand lever.

11 Claims, 6 Drawing Sheets

CHAIR WITH ADJUSTABLE FOOT REST

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of personal and domestic articles including furniture, more specifically, a chair having independently adjustable supporting parts.

SUMMARY OF INVENTION

The chair with adjustable foot rest is a chair. The chair with adjustable foot rest is configured for use in helping an individual don footwear and socks. The chair with adjustable foot rest comprises a bollard, a chair structure, and a foot rest structure. The bollard and the foot rest structure attach to the chair structure. The foot rest structure moves towards and away from the chair such that the foot rest structure will support a foot at a convenient position. The position of the foot rest structure is controlled using a hand lever.

These together with additional objects, features and advantages of the chair with adjustable foot rest will be readily apparent to those of ordinary skill in the art upon reading the following detailed description of the presently preferred, but nonetheless illustrative, embodiments when taken in conjunction with the accompanying drawings.

In this respect, before explaining the current embodiments of the chair with adjustable foot rest in detail, it is to be understood that the chair with adjustable foot rest is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the chair with adjustable foot rest.

It is therefore important that the claims be regarded as including such equivalent construction insofar as they do not depart from the spirit and scope of the chair with adjustable foot rest. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
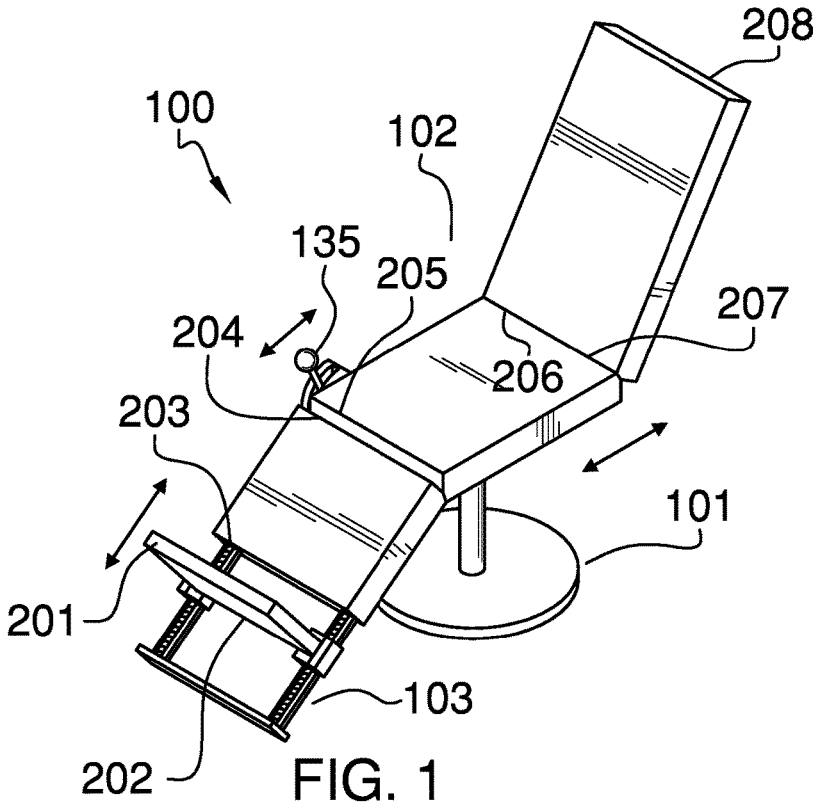
FIG. 1 is a perspective view of an embodiment of the disclosure.
Figure 2:
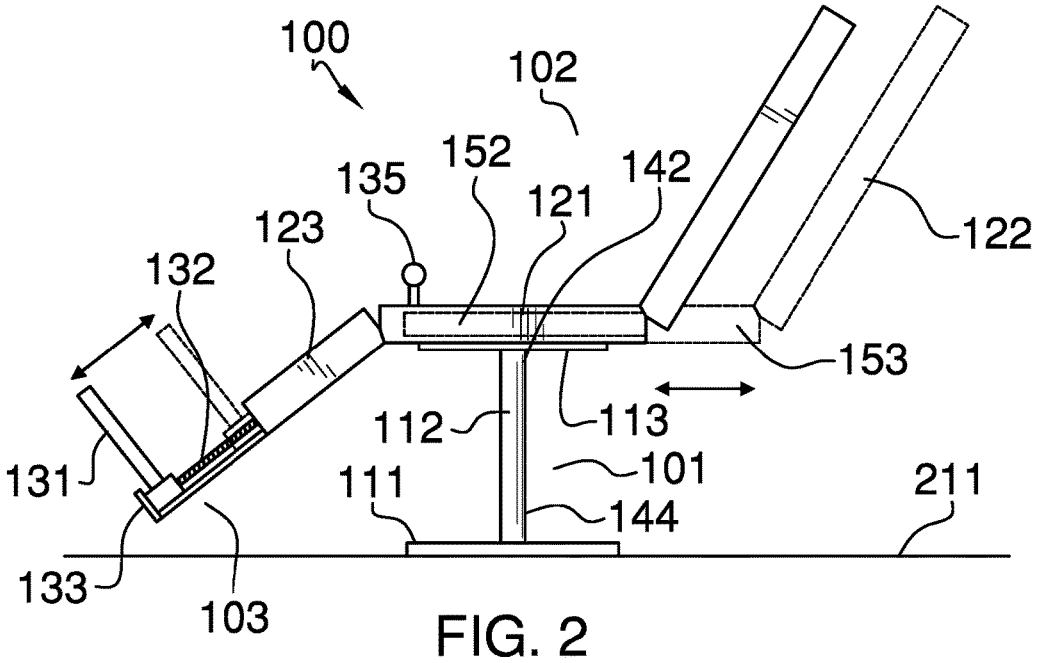
FIG. 2 is a side view of an embodiment of the disclosure.
Figure 3:
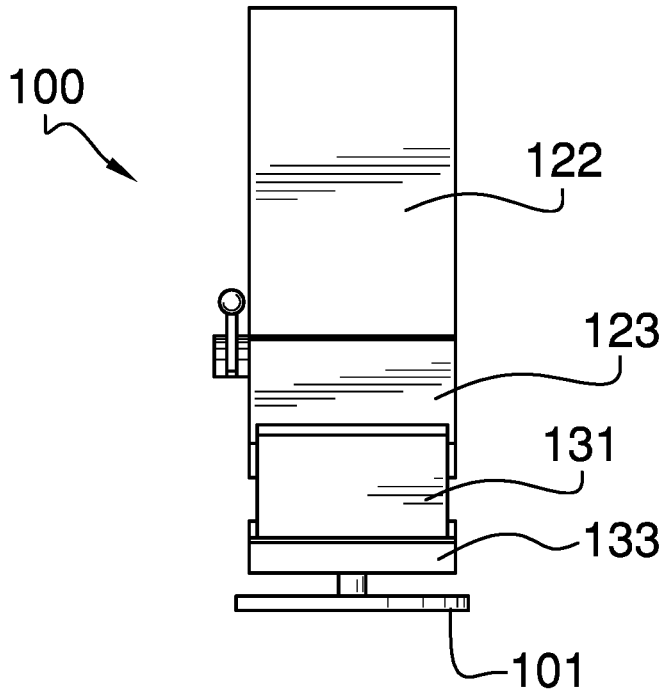
FIG. 3 is a front view of an embodiment of the disclosure.
Figure 4:
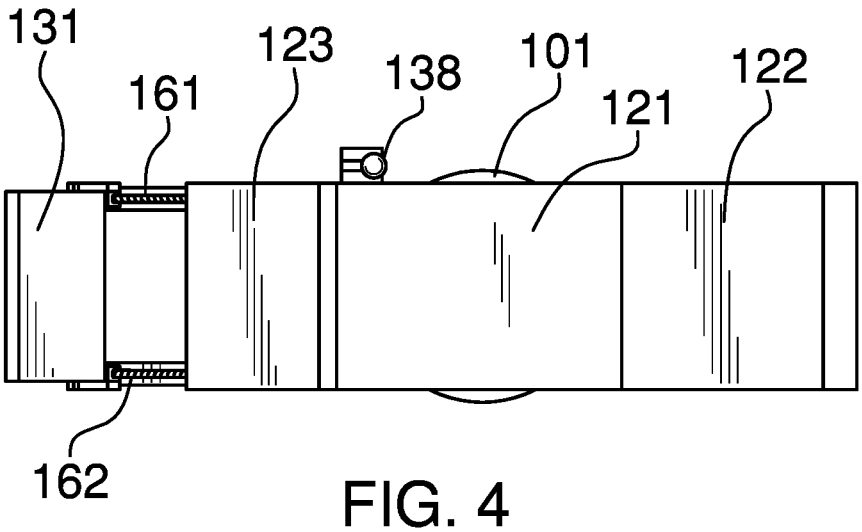
FIG. 4 is a top view of an embodiment of the disclosure.
Figure 5:
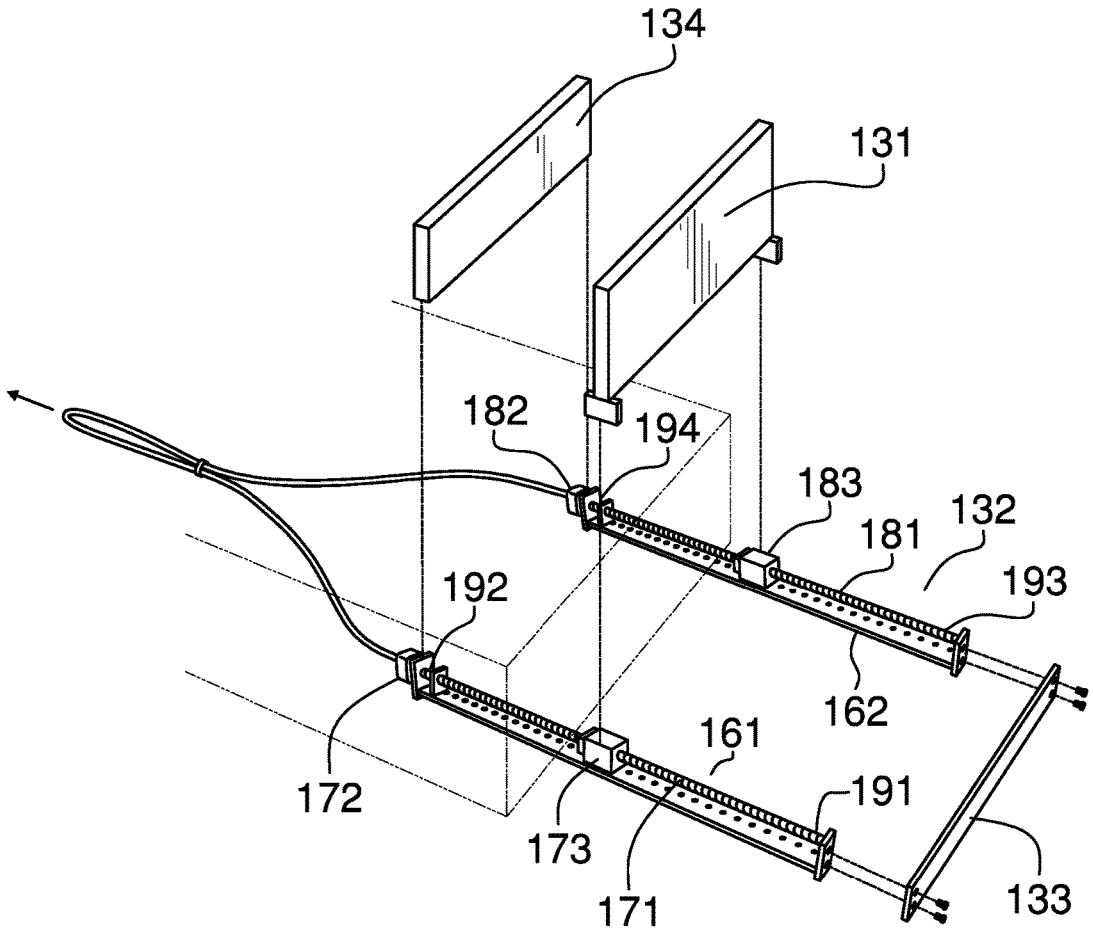
FIG. 5 is an exploded detail view of an embodiment of the disclosure.
Figure 6:
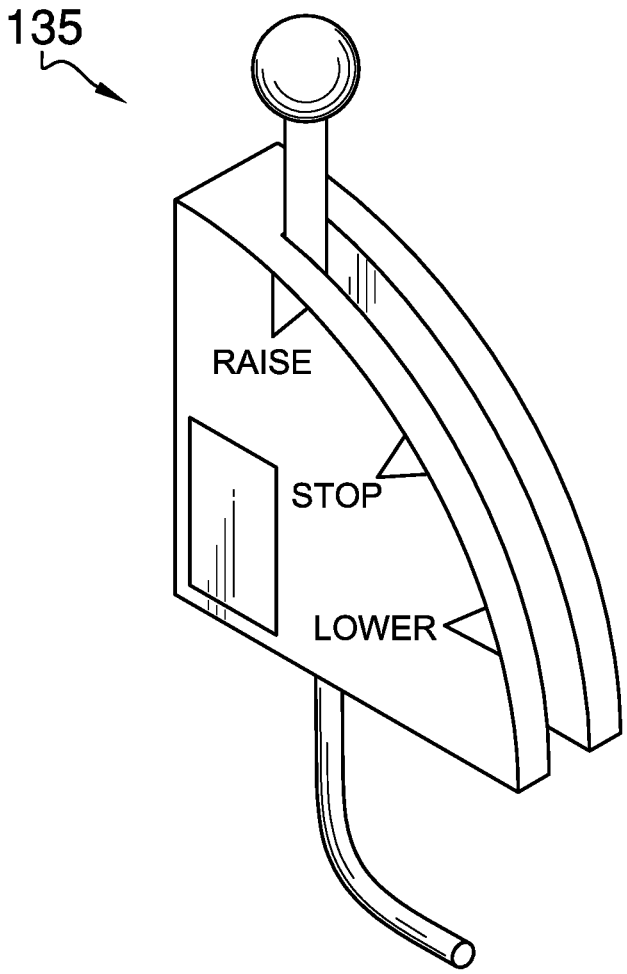
FIG. 6 is a detail view of an embodiment of the disclosure.
Figure 7:
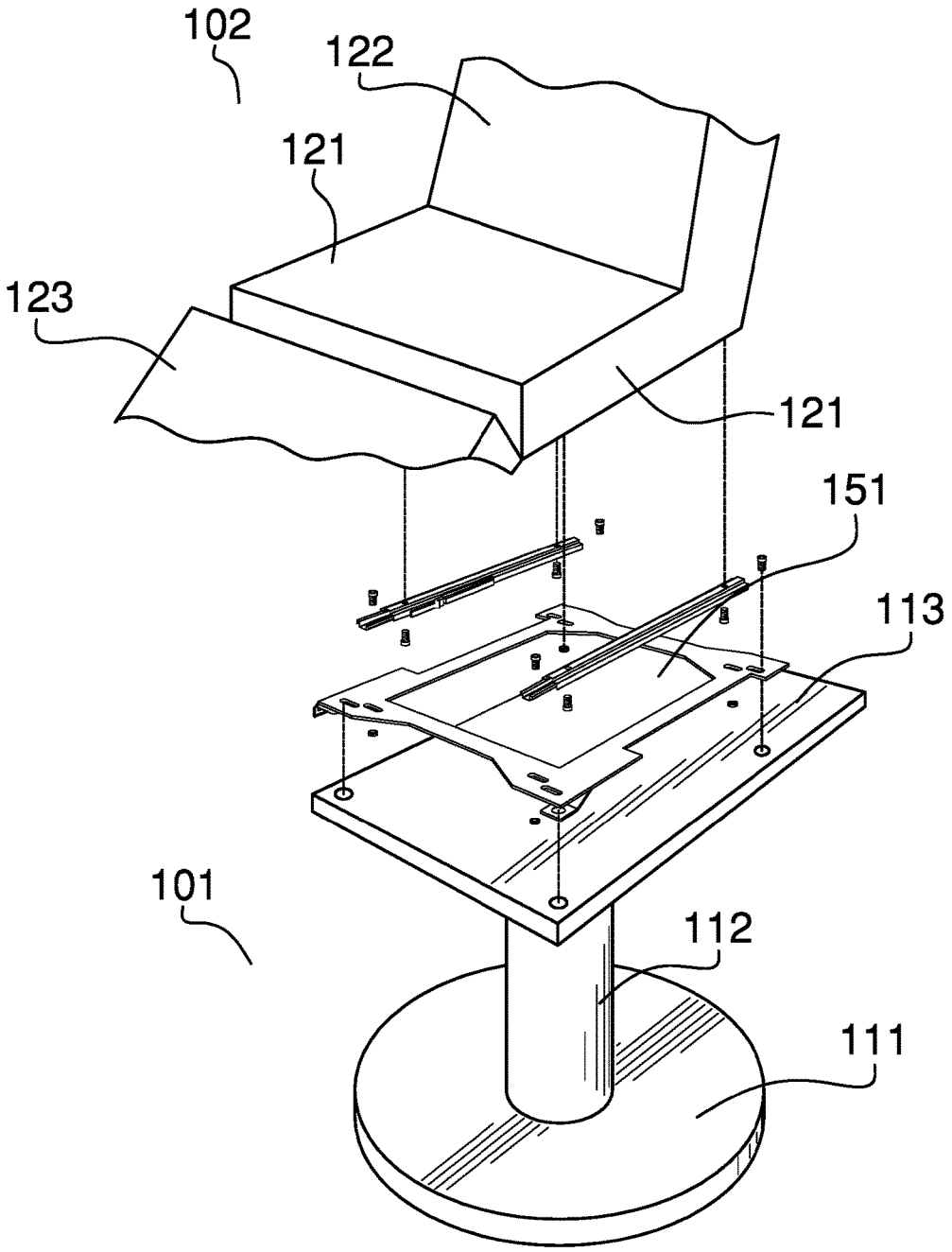
FIG. 7 is an exploded detail view of an embodiment of the disclosure.
Figure 8:
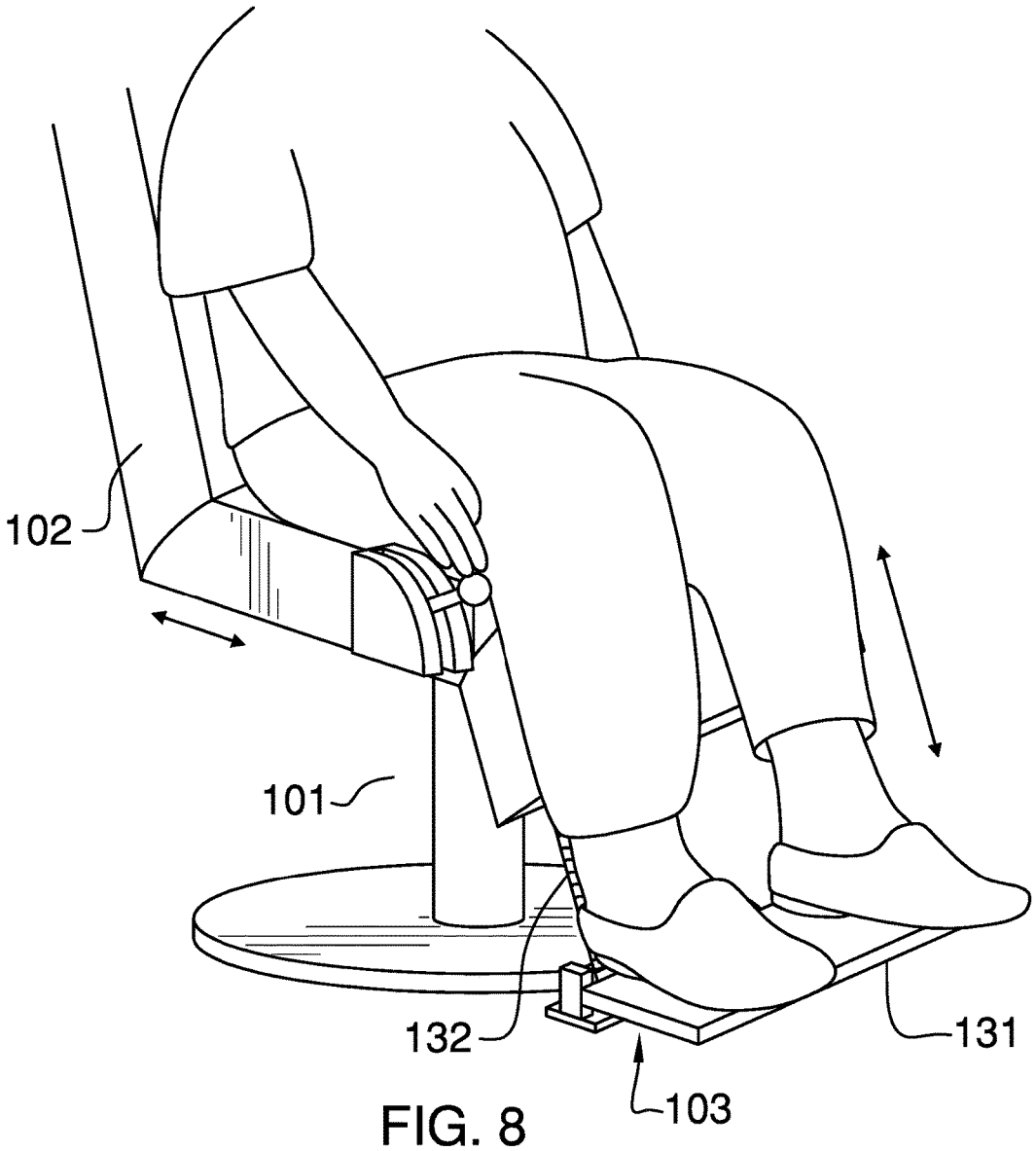
FIG. 8 is an in-use view of an embodiment of the disclosure.

Detailed reference will now be made to one or more potential embodiments of the disclosure, which are illustrated in FIGS. 1 through 8.

The chair with adjustable foot rest 100 (hereinafter invention) is a chair. The invention 100 is configured for use in helping an individual don footwear and socks. The invention 100 comprises a bollard 101, a chair structure 102, and a foot rest structure 103. The bollard 101 and the foot rest structure 103 attach to the chair structure 102. The foot rest structure 103 moves towards and away from the chair such that the foot rest structure 103 will support a foot at a convenient position. The position of the foot rest structure 103 is controlled using a hand lever 135.

The bollard 101 is a supporting structure. The bollard 101 is an extension structure that raises the chair structure 102 above a supporting surface 211. The bollard 101 comprises a pedestal 111, a stanchion 112, and a mounting plate 113.

The pedestal 111 forms the inferior structure of the bollard 101. The pedestal 111 rests upon the supporting surface 211 and forms the last link of the load path between the chair structure 102 and the supporting surface 211. The pedestal 111 is a disk-shaped object.

The stanchion 112 is an extension structure. The stanchion separates the mounting plate 113 from the pedestal 111 in the superior direction. The stanchion 112 is further defined with an inferior stanchion end 141 and a superior stanchion end 142.

The mounting plate 113 is a plate structure used to attach the chair structure 102 to the bollard 101.

The chair structure 102 is a furniture item. The chair structure 102 is a seat upon which an individual sits to don apparel selected from the group consisting of a footwear item and a sock. The foot rest structure 103 is a foot rest used for supporting a foot while donning the selected apparel. The chair structure 102 comprises a bench structure 121, a back support structure 122, and a leg cushion 123. The leg cushion 123 is further defined with a third medial edge 203 and a fourth medial edge 204. The bench structure 121 is further defined with a fifth medial edge 205 and a sixth medial edge 206. The back support structure 122 is further defined with a seventh medial edge 207 and an eighth medial edge 208.

The bench structure 121 is a horizontal surface that mounts directly to the bollard 101. The bench structure 121 is a hollow rectangular block structure. The bench structure 121 forms the surface an individual sits on during use of the invention 100. The bench structure 121 further comprises a bracket 151 and a telescopic cavity 152.

The back support structure 122 is a rectilinear block structure. The back support structure 122 supports the back of the individual using the invention 100. The back support structure 122 attaches to the bench structure 121 telescopically. The back support structure 122 forms a cant relative to the bench structure 121. The position of the back support structure 122 relative to the bench structure 121 is adjustable. The back support structure 122 further comprises a telescopic extension 153.

The bracket 151 is a mechanical structure that attaches the bench structure 121 to the mounting plate 113. The bracket 151 comprises commercially available hardware.

The telescopic cavity 152 is a cavity formed in the bench structure 121 of the chair structure 102. Access into the telescopic cavity 152 is gained through the sixth medial edge 206 of the bench structure 121. The telescopic extension 153 is a rectilinear block structure that attaches to the seventh medial edge 207 of the back support structure 122. The telescopic extension 153 forms a cant relative to the back support structure 122.

The telescopic cavity 152 is a negative space formed as a hollow first prism that is further defined with an inner dimension. The telescopic extension 153 is a second prism that is further defined with an outer dimension. The telescopic cavity 152 and the telescopic extension 153 are geometrically similar. The outer dimension of the telescopic extension 153 is less than the inner dimension of the telescopic cavity 152 such that the telescopic extension 153 inserts into the telescopic cavity 152 in a telescopic manner. This telescopic arrangement combining the bench structure 121 and the back support structure 122 allows the position of the back support structure 122 to be adjusted relative to the bench structure 121 by adjusting the relative position of the telescopic extension 153 within the telescopic cavity 152.

The leg cushion 123 is a rectilinear block structure. The leg cushion 123 supports the legs of the individual using the invention 100. The leg cushion 123 attaches to the bench structure 121. The leg cushion 123 forms a cant relative to the bench structure 121.

The foot rest structure 103 is an adjustable structure. The elevation of the foot rest structure 103 raises and lowers such that the foot rest structure 103 moves to in a position convenient for the individual donning the selected apparel. The foot rest structure 103 comprises a foot plate 131, a plurality of worm drives 132, an inferior end plate 133, and a superior end plate 134.

The foot plate 131 is a rectangular plate structure. The foot plate 131 forms a surface upon which the feet of an individual are placed. The position of the foot plate 131 relative to the bench structure 121 adjusts using the plurality of worm drives 132. The foot plate 131 projects perpendicularly away from the center axes of each of the plurality of worm drives 132. The foot plate 131 is further defined with a first medial edge 201 and a second medial edge 202.

The plurality of worm drives 132 forms a drive system that moves the position of the foot plate 131 relative to the bench structure 121. Each of the plurality of worm drives 132 is a motorized worm drive. The foot plate 131 attaches to each of the plurality of worm drives 132 such that the rotation of each of the plurality of worm drives 132 moves the foot plate 131 in a direction parallel to the center axis of each of the plurality of worm drives 132.

The plurality of worm drives 132 further comprises a left worm drive 161 and a right worm drive 162.

The left worm drive 161 is a first worm drive selected from the plurality of worm drives 132. The left worm drive 161 is positioned along the left side of the chair structure 102. The left worm drive 161 comprises a left worm cylinder 171, a left drive motor 172, and a left worm nut 173. The left worm cylinder 171 is further defined with a left inferior end 191 and a left superior end 192.

The left worm cylinder 171 is a threaded cylindrical shaft that is rotated by the left drive motor 172. The left worm cylinder 171 is formed with an exterior screw thread. The left drive motor 172 attaches the left worm cylinder 171 to the superior end plate 134 such that the left drive motor 172 can rotate the left worm cylinder 171. The operation of the left drive motor 172 is controlled by the hand lever 135. The left worm nut 173 is a nut that is screwed on to the left worm cylinder 171. The left worm nut 173 moves along the center axis of the left worm cylinder 171 when the left drive motor 172 rotates the left worm cylinder 171.

The foot plate 131 attaches to the left worm nut 173 such that: 1) the rotation of the left worm nut 173 moves the foot plate 131 along the center axis of the left worm cylinder 171; and, 2) the plane formed by the foot plate 131 projects perpendicularly away from the center axis of the left worm cylinder 171.

The right worm drive 162 is a second worm drive selected from the plurality of worm drives 132. The right worm drive 162 is positioned along the right side of the chair structure 102. The right worm drive 162 comprises a right worm cylinder 181, a right drive motor 182, and a right worm nut 183. The right worm cylinder 181 is further defined with a right inferior end 193 and a right superior end 194.

The right worm cylinder 181 is a threaded cylindrical shaft that is rotated by the right drive motor 182. The right worm cylinder 181 is formed with an exterior screw thread. The right drive motor 182 attaches the right worm cylinder 181 to the superior end plate 134 such that the right drive motor 182 can rotate the right worm cylinder 181. The operation of the right drive motor 182 is controlled by the hand lever 135. The right worm nut 183 is a nut that is screwed on to the right worm cylinder 181. The right worm nut 183 moves along the center axis of the right worm cylinder 181 when the right drive motor 182 rotates the right worm cylinder 181.

The foot plate 131 attaches to the right worm nut 183 such that: 1) the rotation of the right worm nut 183 moves the inferior stanchion end 141 along the center axis of the right worm cylinder 181; and, 2) the plane formed by the foot plate 131 projects perpendicularly away from the center axis of the right worm cylinder 181.

The inferior end plate 133 is a stabilizing plate that attaches the left worm drive 161 to the right worm drive 162. The superior end plate 134 is a stabilizing plate that attaches the left worm drive 161 to the third medial edge 203 of the leg cushion 123. The superior end plate 134 is a stabilizing plate that attaches the right worm drive 162 to the third medial edge of the leg cushion 123.

The hand lever 135 is a control structure that is hand operated. The hand lever 135 simultaneously operates the left worm drive 161 and the right worm drive 162 to move the foot plate 131 relative to the bench structure 121.

The following three paragraphs describe the assembly of the invention 100.

The pedestal 111 attaches to the inferior stanchion end 141 of the stanchion 112. The mounting plate 113 attaches to the superior stanchion end 142 of the mounting plate 113. The bracket 151 attaches the inferior surface of the bench structure 121 to the superior surface of the mounting plate 113.

The inferior end plate 133 attaches the left inferior end 191 of the left worm cylinder 171 to the right inferior end 193 of the right worm cylinder 181. The left drive motor 172 attaches the left superior end 192 of the left worm cylinder 171 to the superior end plate 134. The right drive motor 182 attaches the right superior end 194 of the right worm cylinder 181 to the superior end plate 134. The left worm nut 173 and the right worm nut 183 attach the second medial edge 202 of the foot plate 131 to the left worm drive 161 and the right worm drive 162. The superior end plate 134 attaches the left worm cylinder 171 and the right worm cylinder 181 to the third medial edge 203 of the leg cushion 123.

The fourth medial edge 204 of the leg cushion 123 attaches to the fifth medial edge 205 of the bench structure 121. The telescopic extension 153 of the back support structure 122 inserts into the telescopic cavity 152 of the bench structure 121. The telescopic extension 153 attaches to the seventh medial edge 207 of the back support structure 122.

The following definitions were used in this disclosure:

Bollard: As used in this disclosure, a bollard is a heavy vertical stanchion used as an anchor point to anchor an object to a horizontal surface. Bollards are often called Samson posts.

Bracket: As used in this disclosure, a bracket is a mechanical structure that attaches a second structure to a first structure such that the load path of the second structure is fully transferred to the first structure.

Cant: As used in this disclosure, a cant is an angular deviation from one or more reference lines (or planes) such as a vertical line (or plane) or a horizontal line (or plane).

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Correspond: As used in this disclosure, the term correspond is used as a comparison between two or more objects wherein one or more properties shared by the two or more objects match, agree, or align within acceptable manufacturing tolerances.

Cylinder: As used in this disclosure, a cylinder is a geometric structure defined by two identical flat and parallel ends, also commonly referred to as bases, which are circular in shape and connected with a single curved surface, referred to in this disclosure as the lateral face. The cross-section of the cylinder remains the same from one end to another. The axis of the cylinder is formed by the straight line that connects the center of each of the two identical flat and parallel ends of the cylinder. Unless otherwise stated within this disclosure, the term cylinder specifically means a right cylinder which is defined as a cylinder wherein the curved surface perpendicularly intersects with the two identical flat and parallel ends.

Disk: As used in this disclosure, a disk is a prism-shaped object that is flat in appearance.

Don: As used in this disclosure, to don means to put a garment on a person.

Electric Motor: In this disclosure, an electric motor is a machine that converts electric energy into rotational mechanical energy.

Elevation: As used in this disclosure, elevation refers to the span of the distance in the superior direction between a specified horizontal surface and a reference horizontal surface.

Extension Structure: As used in this disclosure, an extension structure is an inert physical structure that is used to extend the span of the distance between any two objects.

Exterior Screw Thread: An exterior screw thread is a ridge wrapped around the outer surface of a tube in the form of a helical structure that is used to convert rotational movement into linear movement.

Footwear: As used in this disclosure, footwear refers to a protective structure that is worn on a foot.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Horizontal: As used in this disclosure, horizontal is a directional term that refers to a direction that is either: 1) parallel to the horizon; 2) perpendicular to the local force of gravity, or, 3) parallel to a supporting surface. In cases where the appropriate definition or definitions are not obvious, the second option should be used in interpreting the specification. Unless specifically noted in this disclosure, the horizontal direction is always perpendicular to the vertical direction.

Inferior: As used in this disclosure, the term inferior refers to an edge or surface of an object that would commonly be referred to as the bottom of the object.

Inner Dimension: As used in this disclosure, the term inner dimension describes the span from a first inside or interior surface of a container to a second inside or interior surface of a container. The term is used in much the same way that a plumber would refer to the inner diameter of a pipe.

Interior Screw Thread: An interior screw thread is a groove that is formed around the inner surface of a tube in the form of a helical structure that is used to convert rotational movement into linear movement.

Lateral: As used in this disclosure, the term lateral refers to a side or edge of an object Load: As used in this disclosure, the term load refers to an object upon which a force is acting or which is otherwise absorbing energy in some fashion. Examples of a load in this sense include, but are not limited to, a mass that is being moved a distance or an electrical circuit element that draws energy. The term load is also commonly used to refer to the forces that are applied to a stationary structure.

Load Path: As used in this disclosure, a load path refers to a chain of one or more structures that transfers a load generated by a raised structure or object to a foundation, supporting surface, or the earth.

Medial: As used in this disclosure, medial refers to a directional sense of an object that perpendicularly intersects with the center or center axis of the object.

Negative Space: As used in this disclosure, negative space is a method of defining an object through the use of open or empty space as the definition of the object itself, or, through the use of open or empty space to describe the boundaries of an object.

Nut: As used in this disclosure, a nut is a first object that is formed with a cylindrical negative space that further comprises an interior screw thread such that a second object with a matching exterior screw thread can screwed into the first object forming a threaded connection. A nut is further defined with an inner diameter.

One to One: When used in this disclosure, a one to one relationship means that a first element selected from a first set is in some manner connected to only one element of a second set. A one to one correspondence means that the one to one relationship exists both from the first set the second set and from the second set to the first set. A one to one fashion means that the one to one relationship exists in only one direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pedestal: As used in this disclosure, a pedestal is an intermediary load bearing structure that that transfers a load path between a supporting surface and an object, structure, or load.

Plate: As used in this disclosure, a plate is a smooth, flat and semi-rigid or rigid structure that has at least one dimension that: 1) is of uniform thickness; and 2) that appears thin relative to the other dimensions of the object. Plates often have a rectangular or disk-like appearance. As defined in this disclosure, plates may be made of any material, but are commonly made of metal, plastic, and wood. When made of wood, a plate is often referred to as a board.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Rectangular Block: As used in this disclosure, a rectangular block refers to a three-dimensional structure comprising six rectangular surfaces formed at right angles. Within this disclosure, a rectangular block may further comprise rounded edges and corners.

Rectilinear: As used in this disclosure, rectilinear is an adjective that is used to describe an object that: 1) moves in a straight line or lines; 2) consists of a straight line or lines; 3) is bounded by a straight line or lines; or, 4) is otherwise characterized by a straight line or lines.

Rectilinear Block: As used in this disclosure, a rectilinear block refers to a three-dimensional structure comprising a plurality of rectangular surfaces. Rectilinear blocks are similar to rectangular blocks and are often used to create a structure with a reduced interior volume relative to a rectangular block. Within this disclosure, a rectilinear block may further comprise rounded edges and corners.

Rounded: A used in this disclosure, the term rounded refers to the replacement of an apex, vertex, or edge or brink of a structure with a (generally smooth) curvature wherein the concave portion of the curvature faces the interior or center of the structure.

Rounded Rectangle: A used in this disclosure, a rounded rectangle is a rectangle wherein one or more of the corner structures of the rectangle are replaced with a curvature wherein the concave portion of the curvature faces the center of the rounded rectangle.

Screw: As used in this disclosure, to screw is a verb meaning: 1) to fasten or unfasten (unscrew) a threaded connection; or 2) to attach a helical structure to a solid structure.

Slide: As used in this disclosure, slide is a verb that refers to an object that is transported along a surface while in continuous contact with the surface. An object being transported along a surface with wheels cannot be said to be sliding.

Stanchion: As used in this disclosure, a stanchion refers to a vertical pole, post, or support. See beam and gusset and strut Superior: As used in this disclosure, the term superior refers to an edge or surface of an object that would commonly be referred to as the top of the object.

Supporting Surface: As used in this disclosure, a supporting surface is a horizontal surface upon which an object is placed and to which the load path of the object is transferred. This disclosure assumes that an object placed on the supporting surface is in an orientation that is appropriate for the normal or anticipated use of the object.

Threaded Connection: As used in this disclosure, a threaded connection is a type of fastener that is used to join a first tube-shaped and a second tube-shaped object together. The first tube-shaped object is fitted with a first fitting selected from an interior screw thread or an exterior screw thread. The second tube-shaped object is fitted with the remaining screw thread. The tube-shaped object fitted with the exterior screw thread is placed into the remaining tube-shaped object such that: 1) the interior screw thread and the exterior screw thread interconnect; and, 2) when the tube-shaped object fitted with the exterior screw thread is rotated the rotational motion is converted into linear motion that moves the tube-shaped object fitted with the exterior screw thread either into or out of the remaining tube-shaped object. The direction of linear motion is determined by the direction of rotation.

Vertical: As used in this disclosure, vertical refers to a direction that is either: 1) perpendicular to the horizontal direction; 2) parallel to the local force of gravity; or, 3) when referring to an individual object the direction from the designated top of the individual object to the designated bottom of the individual object. In cases where the appropriate definition or definitions are not obvious, the second option should be used in interpreting the specification. Unless specifically noted in this disclosure, the vertical direction is always perpendicular to the horizontal direction.

With respect to the above description, it is to be realized that the optimum dimensional relationship for the various components of the invention described above and in FIGS. 1 through 8 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. An adjustable chair comprising
a bollard, a chair structure, and a foot rest structure;
wherein the bollard and the foot rest structure attach to the chair structure;
wherein the foot rest structure moves towards and away from the chair;
wherein the position of the foot rest structure is controlled using a hand lever;
wherein the bollard is an extension structure that raises the chair structure above a supporting surface;
wherein the foot rest structure comprises a foot plate, a plurality of worm drives, an inferior end plate, and a superior end plate;
wherein the foot plate is further defined with a first medial edge and a second medial edge;
wherein the bollard comprises a pedestal, a stanchion, and a mounting plate;
wherein the pedestal and the mounting plate attach to the stanchion;
wherein the pedestal rests upon a supporting surface;
wherein the pedestal forms the last link of the load path between the chair structure and the supporting surface;
wherein the pedestal is a disk-shaped object;
wherein the stanchion is an extension structure;
wherein the stanchion separates the mounting plate from the pedestal;
wherein the stanchion is further defined with an inferior stanchion end and a superior stanchion end;
wherein the mounting plate is a plate structure;
wherein the mounting plate attaches the chair structure to the bollard;
wherein the chair structure comprises a bench structure, a back support structure, and a leg cushion;
wherein the back support structure and the leg cushion attach to the bench structure;
wherein the leg cushion is further defined with a third medial edge and a fourth medial edge;
wherein the bench structure is further defined with a fifth medial edge and a sixth medial edge;
wherein the back support structure is further defined with a seventh medial edge and an eighth medial edge;
wherein the foot rest structure is an adjustable structure;
wherein the elevation of the foot rest structure adjusts relative to the chair structure;
wherein the bench structure is a horizontal surface;
wherein the bench structure mounts on the bollard;
wherein the bench structure is a hollow rectangular block structure;
wherein the back support structure is a rectilinear block structure;
wherein the back support structure attaches to the bench structure telescopically;
wherein the back support structure forms a cant relative to the bench structure;
wherein the position of the back support structure relative to the bench structure is adjustable;
wherein the leg cushion is a rectilinear block structure;
wherein the leg cushion attaches to the bench structure;
wherein the leg cushion forms a cant relative to the bench structure;
wherein the bench structure further comprises a bracket;
wherein the bracket is a mechanical structure that attaches the bench structure to the mounting plate;
wherein the bench structure further comprises a telescopic cavity;
wherein the telescopic cavity is a cavity formed in the bench structure of the chair structure;
wherein the telescopic cavity is a negative space formed in the shape of a hollow first prism that is further defined with an inner dimension;
wherein access into the telescopic cavity is through the sixth medial edge of the bench structure.

2. The adjustable chair according to claim 1
wherein the back support structure further comprises a telescopic extension;
wherein the telescopic extension is a rectilinear block structure that attaches to the seventh medial edge of the back support structure;
wherein the telescopic extension forms a cant relative to the back support structure;
wherein the telescopic extension forms a second prism that is further defined with an outer dimension.

3. The adjustable chair according to claim 2
wherein the outer dimension of the telescopic extension is less than the inner dimension of the telescopic cavity such that the telescopic extension inserts into the telescopic cavity in a telescopic manner;
wherein the position of the back support structure adjusts relative to the bench structure by adjusting the relative position of the telescopic extension within the telescopic cavity.

4. The adjustable chair according to claim 3
wherein the inferior end plate, the superior end plate, and the foot plate attach to the plurality of worm drives.

5. The adjustable chair according to claim 4
wherein the foot plate is a rectangular plate structure;
wherein the position of the foot plate relative to the chair structure adjusts using the plurality of worm drives;

wherein the foot plate projects perpendicularly away from the center axes of each of the plurality of worm drives.

6. The adjustable chair according to claim 5 wherein the plurality of worm drives forms a drive system;

wherein the plurality of worm drives move the position of the foot plate relative to the chair structure;

wherein the foot plate attaches to each of the plurality of worm drives such that the rotation of each of the plurality of worm drives moves the foot plate in a direction parallel to the center axis of each of the plurality of worm drives.

7. The adjustable chair according to claim 6 wherein the plurality of worm drives further comprises a left worm drive and a right worm drive;

wherein the left worm drive is a first worm drive selected from the plurality of worm drives;

wherein the right worm drive is a second worm drive selected from the plurality of worm drives;

wherein the left worm drive comprises a left worm cylinder, a left drive motor, and a left worm nut;

wherein the left drive motor and the left worm nut attach to the left worm cylinder wherein the left worm cylinder is further defined with a left inferior end and a left superior end;

wherein the right worm drive comprises a right worm cylinder, a right drive motor, and a right worm nut;

wherein the right drive motor and the right worm nut attach to the right worm cylinder wherein the right worm cylinder is further defined with a right inferior end and a right superior end.

8. The adjustable chair according to claim 7 wherein the left worm cylinder is a threaded cylindrical shaft that is rotated by the left drive motor;

wherein the left worm cylinder is formed with an exterior screw thread;

wherein the left drive motor attaches the left worm cylinder to the superior end plate such that the left drive motor can rotate the left worm cylinder;

wherein the operation of the left drive motor is controlled by the hand lever;

wherein the left worm nut is a nut that is screwed on to the left worm cylinder;

wherein the left worm nut moves along the center axis of the left worm cylinder when the left drive motor rotates the left worm cylinder;

wherein the foot plate attaches to the left worm nut such that the rotation of the left worm nut moves the foot plate along the center axis of the left worm cylinder;

wherein the foot plate attaches to the left worm nut such that the plane formed by the foot plate projects perpendicularly away from the center axis of the left worm cylinder.

9. The adjustable chair according to claim 8 wherein the right worm cylinder is a threaded cylindrical shaft that is rotated by the right drive motor;

wherein the right worm cylinder is formed with an exterior screw thread;

wherein the right drive motor attaches the right worm cylinder to the superior end plate such that the right drive motor can rotate the right worm cylinder;

wherein the operation of the right drive motor is controlled by the hand lever;

wherein the right worm nut is a nut that is screwed on to the right worm cylinder;

wherein the right worm nut moves along the center axis of the right worm cylinder when the right drive motor rotates the right worm cylinder;

wherein the foot plate attaches to the right worm nut such that the rotation of the right worm nut moves the inferior stanchion end along the center axis of the right worm cylinder;

wherein the foot plate attaches to the right worm nut such that the plane formed by the foot plate projects perpendicularly away from the center axis of the right worm cylinder.

10. The adjustable chair according to claim 9 wherein the inferior end plate is a plate that attaches the left worm drive to the right worm drive;

wherein the superior end plate is a plate that attaches the left worm drive to the leg cushion;

wherein the superior end plate is a plate that attaches the right worm drive to the leg cushion.

11. The adjustable chair according to claim 10 wherein the pedestal attaches to the inferior stanchion end of the stanchion;

wherein the mounting plate attaches to the superior stanchion end of the mounting plate;

wherein the bracket attaches the inferior surface of the bench structure to the superior surface of the mounting plate;

wherein the inferior end plate attaches the left inferior end of the left worm cylinder to the right inferior end of the right worm cylinder;

wherein the left worm nut and the right worm nut attach the second medial edge of the foot plate to the left worm drive and the right worm drive;

wherein the superior end plate attaches the left worm cylinder and the right worm cylinder to the third medial edge of the leg cushion;

wherein the fourth medial edge of the leg cushion attaches to the fifth medial edge of the bench structure;

wherein the telescopic extension of the back support structure inserts into the telescopic cavity of the bench structure;

wherein the telescopic extension attaches to the seventh medial edge of the back support structure.

* * * * *